United States Patent [19]

Vieira

[11] Patent Number: 4,919,426

[45] Date of Patent: Apr. 24, 1990

[54] DUST COVER FOR GAME BOARD

[76] Inventor: Walter S. Vieira, 370 New Boston Rd., Acushnet, Mass. 02743

[21] Appl. No.: 329,544

[22] Filed: Mar. 28, 1989

[51] Int. Cl.[5] ..... A63F 3/00

[52] U.S. Cl. ..... 273/148 R; 220/235; 220/377; 273/DIG. 30

[58] Field of Search ..... 220/234, 377, 200, 335; 273/287, DIG. 30, 121 A, 148 R

[56] References Cited

U.S. PATENT DOCUMENTS 902,705 11/1908 Anderson ..... 220/335

4,303,246 12/1981 Strongin ..... 273/153 S

*Primary Examiner*—Anton O. Oechsle

*Attorney, Agent, or Firm*—H. Jay Spiegel

[57] ABSTRACT

The present invention relates to a dust cover for a game board which is preferably made of a transparent material such as plastic. The periphery of the cover is sized to facilitate placing of the cover over a game board such as, for example, a Scrabble board. A portion of the cover defines a pouring spout so that the board, with the cover mounted thereover may be inverted to allow game pieces to fall onto the cover whereupon the cover and board may be tilted to allow all game pieces to be poured into a container through the pouring spout. A hinge may be provided adjacent the pouring spout to allow pivoting thereof to a position allowing pouring of the game pieces into the container.

6 Claims, 1 Drawing Sheet

DUST COVER FOR GAME BOARD

BACKGROUND OF THE INVENTION

The present invention relates to a dust cover for a game board. In the prior art, protective covers for various products are well known. For example, dust covers for use with typewriters and phonograph turntables are known. Furthermore, storage devices for game pieces are well known as taught, for example, by U.S. Pat. No. 1,541,554 to Everitt and U.S. Pat. No. 3,921,983 to Taylor.

Finally, game boards having a cover hingedly mounted thereto to allow storage of game pieces and carrying of a game are known as taught by U.S. Pat. No. 4,705,275 to Slater.

However, applicant is unaware of any prior art which teaches the concept of a cover designed to be used to cover a game board and which includes a pouring spout allowing the board and cover to be inverted to allow easy removal of game pieces from the board.

SUMMARY OF THE INVENTION

The present invention relates to a dust cover for a game board. The invention includes the following interrelated aspects and features:

(a) In a first aspect, the periphery of the cover is sized to closely correspond to the periphery of a game board with which the dust cover is designed to be used.

(b) The dust cover has side walls which space a top portion of the dust cover a predetermined distance away from the surface of the game board.

(c) Preferably one corner of the cover is provided with a pouring spout through which game pieces may be slid after inverting the dust cover and game board.

(d) Adjacent the corner, a hinge is preferably formed in the top portion of the cover to allow easy removal of all game pieces by pouring them out into a separate container such as a bag, can or the like after pivoting the pouring spout about the hinge with the game pieces contained therein.

As such, it is the first object of the present invention to provide an improved functional dust cover for a game board.

It is further object of the present invention to provide such a dust cover including a hinged, folding or opening corner incorporated therewith comprising a pouring spout.

It is a yet further object of the present invention to provide such a pouring spout hingedly mounted to allow easy opening, folding and locking in place.

These and other objects, aspects and features of the present invention will be better understood from the following detailed description of the preferred embodiment when read in conjunction with the appended drawings figures.

SPECIFIC DESCRIPTION OF THE PREFERRED EMBODIMENTS

Figure 1:
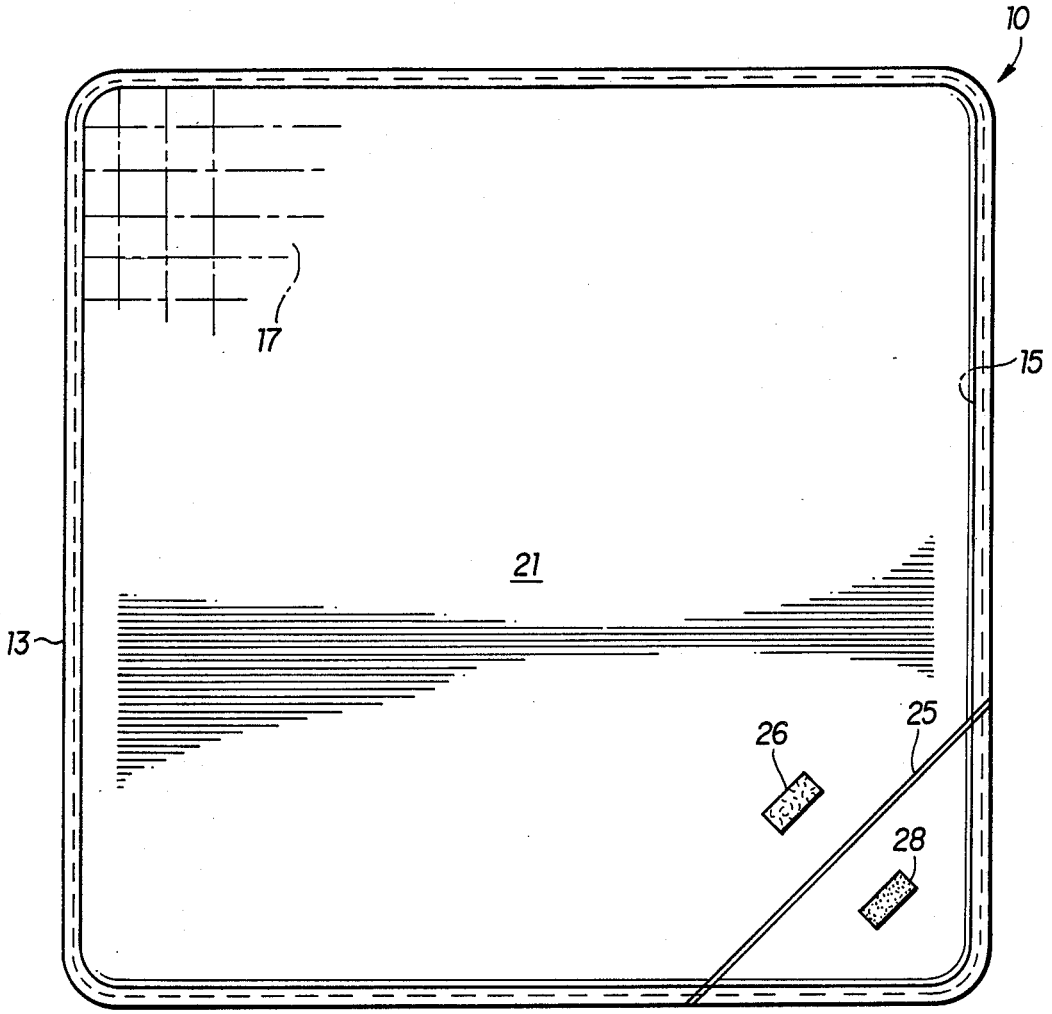
FIG. 1 shows a top view of the present invention.

With reference to the figures, the inventive cover is generally designated by the reference numeral 10 and is seen to include a bottom opening 11 surrounded by a lip 13 designed with inner surfaces 15 designed to snap over and retain therein the periphery of a game board 17 shown in phantom in FIG. 1.

Figure 2:
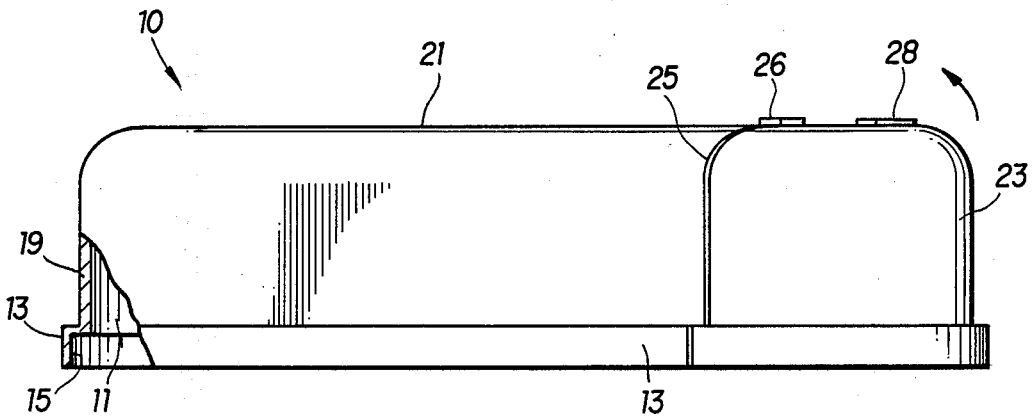
FIG. 2 shows a front view of the present invention.

With reference to FIG. 2, the cover 10 includes peripheral side walls 19 which space the top 21 of the cover a predetermined desired distance above the surface of the game board 17.

In one corner of the top surface 21 of the cover 10, a pouring spout 23 is provided which is sized to define a volume sufficiently large enough to allow all game pieces which may be used in playing the game on the game board 17 to pass therethrough. The pouring spout 23 is attached by a hinge 25 in the top surface 21 of the cover 10. A fastener 26, 28 such as hook and pile fastening means may be used to maintain the pouring spout 23 in an open position.

The inventive dust cover 10 of the present invention is best used in conjunction with a game board on which the game pieces are difficult to remove after the playing of the game. For example, boards sold under the registered trademark SCRABBLE as they are now manufactured include square recesses defining each space on the board and may also include upstanding portions at each opposed end of the board allowing the storing of letters which are not being used on the board. The height of the side wall 19 of the cover 10 is designed to be sufficiently sized so as to allow the cover 10 to be placed over SCRABBLE board, for example, without interference from these upstanding game piece storing portions.

The nature of the square-shaped recesses defining spaces on some SCRABBLE boards makes it difficult to remove game pieces therefrom when the game is over. When game pieces are eventually removed, they may easily fall off the board and onto the floor or adjacent surfaces. Thus, the inventive cover 10 is an extremely valuable tool in preventing such problems. In order to remove game pieces from a SCRABBLE board after the game has been played, one must merely snap the inventive cover 10 onto the periphery of the board, and thereafter, one must merely invert the board and angle the inverted board and cover in a direction wherein the pouring spout is at the lowest end. In this way, all pieces will be removed from the game board and will fall through the pouring spout 23 and into a container.

All game pieces may easily be removed through the pouring spout by opening the pouring spout about the hinge 25 and locking it in an open position using the fastening means 26, 28 so that all game pieces may easily be poured into an associated container such as, for example, a bag, can or the like.

Of course, the teachings of the present invention may easily be applied to any game board whether or not the pieces are easily removable therefrom. Thus, for example, a board sold under the registered trademark MONOPOLY which is completely flat may easily be cleared through the teachings of the present invention.

In the preferred embodiment of the present invention, the inventive cover 10 is made of any transparent material which may be easily and inexpensively formed such as, for example, injection molded plastic. In this way, when the cover 10 is being used, the user may observe that all game pieces have been removed from the board; and not lost on the floor. Of course, any materials which are light weight and easy to manufacture may be used in making the inventive cover 10.

As such, an invention has been disclosed in terms of a preferred embodiment thereof which fulfills each and every one of the objects of the invention as set forth hereinabove and provides a new and improved dust cover for a game board which may be used to ease the clearing of the game board after a game has been played thereon. Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A cover for a game board comprising:

(a) a top portion having sides connected thereto, said sides terminating together to define and opening having a substantially continuous peripheral cover edge mountable over edges of a game board to define therewith an enclosed chamber;

(b) said top portion having a corner which in a first position thereof is substantially continuous with said top portion and cover edge and which may be selectively pivoted to a second position to thereby provide an opening;

(c) whereby said game board and cover may be assembled together and inverted so that said game board is above said cover with a playing surface of said game board facing generally downwardly, thereafter said corner may be pivoted to said second position thereof to thereby expose said opening, whereby said game pieces may be removed from said game board by poring them through said opening.

2. The invention of claim 1, wherein said cover is transparent.

3. The invention of claim 1, wherein said cover is made of plastic.

4. The invention of claim 1, further wherein said top portion has a hinge allowing said pivoting of said corner.

5. The invention of claim 4, further including locking means for locking said corner in said second position.

6. The invention of claim 1, wherein said corner comprises a pouring spout in said second position.

* * * * *